US007326130B2

(12) United States Patent
Ninomiya et al.

(10) Patent No.: US 7,326,130 B2
(45) Date of Patent: Feb. 5, 2008

(54) MULTI-PIECE GOLF BALL AND MANUFACTURING METHOD THEREOF

(75) Inventors: Norikazu Ninomiya, Osaka (JP); Kenji Onoda, Kashihara (JP); Masao Ogawa, Osaka (JP); Yuri Naka, Katano (JP)

(73) Assignee: Mizuno Corporation, Osaka-shi (JP)

( * ) Notice: Subject to any disclaimer, the term of this patent is extended or adjusted under 35 U.S.C. 154(b) by 58 days.

(21) Appl. No.: 11/147,169

(22) Filed: Jun. 8, 2005

(65) Prior Publication Data

US 2006/0058117 A1 Mar. 16, 2006

(30) Foreign Application Priority Data

Jun. 9, 2004 (JP) ..... 2004-171702

(51) Int. Cl.
*A63B 37/06* (2006.01)

(52) U.S. Cl. ..... 473/377

(58) Field of Classification Search ..... 473/374, 473/373, 377, 376

See application file for complete search history.

(56) References Cited

U.S. PATENT DOCUMENTS

| | | | | |
|---|---|---|---|---|
| 698,516 | A | 4/1902 | Kempshall | |
| 4,173,345 | A | 11/1979 | Pocklington | |
| 4,229,401 | A | 10/1980 | Pocklington | |
| 4,660,830 | A | 4/1987 | Tomar | |
| 5,692,973 | A | 12/1997 | Dalton | |
| 5,820,485 | A | 10/1998 | Hwang | |
| 5,836,834 | A | 11/1998 | Masutani et al. | |
| 5,984,807 | A | 11/1999 | Wai et al. | |
| 6,004,226 | A | 12/1999 | Asakura | |
| 6,039,910 | A | 3/2000 | Tanaka et al. | |
| 6,126,560 | A | 10/2000 | Maruoka et al. | |
| 6,155,935 | A | 12/2000 | Maruko | |
| 6,213,893 | B1 | 4/2001 | Maruko et al. | |
| 6,217,462 | B1 | 4/2001 | Maruko et al. | |
| 6,293,877 | B1 | 9/2001 | Boehm | |
| 6,296,578 | B1 | 10/2001 | Masutani | |
| 6,398,667 | B1 | 6/2002 | Lemons | |
| 6,440,346 | B1 * | 8/2002 | Wai et al. | 264/254 |
| 6,485,378 | B1 * | 11/2002 | Boehm | 473/374 |
| 6,835,146 | B2 | 12/2004 | Jordan et al. | |

(Continued)

FOREIGN PATENT DOCUMENTS

JP 1965-003456 1/1940

(Continued)

*Primary Examiner*—Raeann Trimiew
(74) *Attorney, Agent, or Firm*—Kratz, Quintos & Hanson, LLP

(57) ABSTRACT

A multi-piece golf ball has a core (3), an interlayer (5), and a cover (7), the core (3) being provided with a spherical main part (31) and a plurality of ribs (32) formed on the main part (31), the interlayer (5) being accommodated in depressions (33) surrounded by the ribs (32) and having a thickness substantially the same as the height of the ribs (32), each of the ribs (32) extending in such a manner that the width thereof becomes greater from the cover towards the core, each of the depressions (33) being formed into a cone-like shape by side faces of the ribs (32), and the hardness of the interlayer (5) being less than that of the core (3). This structure achieves satisfactory soft feeling and high bounce resilience.

10 Claims, 8 Drawing Sheets

U.S. PATENT DOCUMENTS

| | | | | |
|---|---|---|---|---|
| 6,955,613 | B2 * | 10/2005 | Ninomiya et al. | 473/367 |
| 7,169,065 | B2 * | 1/2007 | Ninomiya et al. | 473/370 |
| 7,192,367 | B2 * | 3/2007 | Ninomiya et al. | 473/374 |
| 2002/0016225 | A1 | 2/2002 | Maruko et al. | |
| 2003/0083153 | A1 | 5/2003 | Sullivan et al. | |
| 2004/0138006 | A1 | 7/2004 | Ninomiya et al. | |
| 2004/0254031 | A1 * | 12/2004 | Ninomiya et al. | 473/371 |
| 2005/0255944 | A1 * | 11/2005 | Ninomiya et al. | 473/371 |

FOREIGN PATENT DOCUMENTS

| | | |
|---|---|---|
| JP | 1974-136364 | 3/1948 |
| JP | 1985-241463 | 11/1985 |
| JP | 1987-073932 | 4/1987 |
| JP | 1987-270178 | 11/1987 |
| JP | 1998-337340 | 12/1998 |
| JP | 2000-084120 | 3/2000 |
| JP | 2000-288122 | 10/2000 |
| JP | 2001-112889 | 4/2001 |
| JP | 2001-112890 | 4/2001 |
| JP | 2001-340493 | 12/2001 |
| JP | 2004-041743 | 2/2004 |
| WO | WO2004-087265 | 10/2004 |

* cited by examiner (a)

(b)

(a)

(b)

(a)

(b)

MULTI-PIECE GOLF BALL AND MANUFACTURING METHOD THEREOF

TECHNICAL FIELD

The present invention relates to a multi-piece golf ball having a plurality of layers, and a manufacturing method thereof.

BACKGROUND OF THE INVENTION

Recently, several kinds of golf balls exhibiting both high bounce resilience and a soft feel when hit have been proposed. One example of such a golf ball is a multi-piece golf ball in which the ball is composed of a plurality of layers. Generally, in a multi-layered golf ball, especially in a golf ball that has three or more layers, a highly rigid core is covered with an interlayer that has relatively low rigidity, and the outer surface of the interlayer is covered with a hard cover. This arrangement aims at attaining both high bounce resilience and a soft feel when hit by virtue of the rigidity of the core and the softness of the interlayer. One example of such a multi-piece golf ball is disclosed in Japanese Examined Patent Publication No. 1991-52310.

However, golf balls having such a conventional multi-layer structure do not always exhibit a satisfactorily soft feel when hit and further improvement in this regard is desired.

DISCLOSURE OF THE INVENTION

The multi-piece golf ball of the present invention comprises a core, an interlayer, and a cover, wherein the core comprises a spherical main part and a plurality of ribs provided on the main part, the interlayer is accommodated in depressions surrounded by the ribs, and has a thickness substantially the same as the height of the ribs, each of the ribs extends in such a manner that the width thereof becomes greater from the cover towards the core, each of the depressions is formed into a cone-like shape by side faces of the ribs, and the hardness of the interlayer is less than that of the core.

In this structure, the core comprises a plurality of ribs, and the interlayer is accommodated in the depressions surrounded by the ribs. Each of the ribs extends in such a manner that the width thereof becomes greater towards the main part of the core, and each depression is thereby formed into a cone-like shape. Therefore, in the region between the main part and the cover, the proportion of the ribs increases from the cover towards the main part on a spherical surface having the same central point as the core. In other words, the proportion of the interlayer is large in the vicinity of the cover, while the proportion of the area of the ribs increases towards the main part, so that the interlayer between the core and the cover has functionally graded properties in which two properties gradually change.

In the present invention, because the core is harder than the interlayer, the hardness of the ball becomes greater from the cover to the main part. Therefore, a soft feel can be obtained during the initial stage of impact, while the hardness increases as impact progresses, obtaining high ball bounce resilience. Because these inherently conflicting properties can be smoothly changed during impact in the golf ball of the present invention, both soft feeling and high ball bounce resilience can be achieved, improving the balance of the properties of the ball.

When the hardness of the core is greater than that of the interlayer, because the soft interlayer is accommodated in the concave portions surrounded by the hard ribs, deformation of the interlayer in the circumferential direction is limited by the ribs. This prevents the striking force from being dispersed in the circumferential direction, and makes it possible to efficiently transfer the striking force to the center of the ball. As a result, in spite of the soft feel, a long carry distance can be attained.

In the present invention, "cone-like shape" refers to a shape such that each depression forms a somewhat conical region by being surrounded by rib side faces, and the area of a plane formed by excising a region along a spherical surface having the same central point as the core decreases as the excising surface moves inwards from the cover to the core. The shape of the above-described plane is not limited and may be, e.g., polygonal as well as circular. In some embodiments, the depression is formed into a cone-like shape by being surrounded only by ribs, while in other embodiments, the main part is exposed at the bottom of the depression, and the side faces of the ribs and the main part together define the cone-like shape. Even when the main part is unexposed, the core of the present invention is so designed that ribs are disposed based on the spherical main part. Even when the main part is exposed, the exposed area thereof is small and a cone-like shape is formed overall.

It is preferable that the height of the ribs of the above-described golf ball be in the range of from 4.6 to 11.2 mm. Having a height in this range can make the proportion of the region between the main part and the cover, i.e., the ribs and the interlayer, large in the radial direction of the golf ball, improving the balance between the soft feeling and the high bounce resilience property. In other words, the feeling when hit is adequately soft and a long carry distance can be achieved. In this case, the diameter of the main part can be small, making it easier to mold the core. In other words, in prior-art golf balls, if the diameter of the core is large, when the core is formed from, for example, a rubber composition, it is difficult to satisfactorily vulcanize the center thereof, and this varies the hardness of the core along the radial direction. In contrast, if the diameter of the main part of the core is relatively small as described above, it is possible to satisfactorily vulcanize the center of the core, and therefore a core having a uniform hardness can be obtained.

In the above-described golf ball, the ribs on the core may be variously modified. For example, the ribs may be formed so as to extend along three great circles on the surface of the main part. This arrangement makes the area of the ribs on the surface of the core relatively small, the area of the interlayer is therefore increased. In this structure, the club can easily give an impact on the interlayer, obtaining soft feeling.

In the above-described golf ball, it is also possible to arrange the ribs such that each of the ribs comprises at least one notch so as to form a passageway between adjacent depressions. Forming notches in the ribs has the following advantages during manufacturing. For example, when a golf ball of the present invention is manufactured by molding a core, placing it in a mold together with a material for the interlayer, and press molding, because the adjacent depressions communicate with each other via the notches, when press molding is conducted, the material for the interlayer spreads throughout the depressions through the notches. This makes it unnecessary to separately insert a material for the interlayer into each of the depressions, simplifying the manufacturing equipment and reducing the manufacturing time. When the interlayer is formed by injection molding, the interlayer can be formed by using one or a small number of gates, thus reducing production equipment costs.

In this structure, each of the ribs may extend along three great circles intersecting each other at right angles on the surface of the main part, and a notch, by which four concave portions that are arranged so as to have their common meeting point at an intersection of the great circles are made to communicate with each other, is formed by excising the rib by a plane that is perpendicular to a normal line of the core and that passes through the intersection of the great circles. In this arrangement, the notch is at an angle of 90° relative to the normal line of the core. This angle serves as a draft angle, and, for example, when the core is molded using two molds, such as an upper mold and a lower mold, the core can be easily removed from the mold.

It is also preferable that each of the ribs extend along three great circles intersecting each other at right angles on the surface of the main part, that each arc section partitioned by the intersections of the great circles be provided with at least one notch, that each notch have a plane extending along the arc section from one point on a normal line of the core that passes through the intersection of the great circle, and that the plane have an angle not smaller than 90° relative to the normal line. Because the angle made between the plane and the normal line is not smaller than 90°, the angle serves as a draft angle, and, as described in above, for example, when the core is molded using two molds, such as an upper mold and a lower mold, the core can be easily removed from the mold.

From the viewpoint of making adjacent depressions communicate with each other, a notch may be formed in the middle of each arc section in the arc direction. It is preferable that such a notch have two planes that each extends toward an intersection from a point on the normal line of the spherical body that passes through the mid point of each arc section in the arc direction, wherein the angle made between the planes and the normal line is 45 to 48°. This arrangement allows the above angle made between the planes and the normal line to serve as a draft angle, so that the core can be removed from the mold easily.

A method for manufacturing a multi-piece golf ball of the present invention is a method for manufacturing a multi-piece golf ball having a core, an interlayer, and a cover. The method comprises the steps of preparing a first mold that comprises a cavity provided with a base having a spherical surface and a plurality of grooves formed along the spherical surface of the base having substantially the same depth as each other as measured from the spherical surface and whose width narrows as they become deeper, and protrusions surrounded by the grooves formed into a cone-like shape; molding a core having a plurality of ribs on the surface of a spherical main part by inserting a core material into the cavity of the first mold; preparing a second mold having a spherical cavity corresponding to the outermost diameter of the core; molding an interlayer whose hardness is less than that of the core by placing the core removed from the first mold into the cavity of the second mold and then inserting an interlayer material into depressions surrounded by the ribs; and molding a cover over the interlayer.

This method makes it possible to manufacture a high-performance multi-piece golf ball having functionally graded properties between the cover and the core. In the second mold, because the cavity corresponds to the outermost diameter of the core, it is possible to insert an interlayer material with the ribs in contact with the surface of the cavity. Therefore, the core can be easily centered, and this makes it possible to accurately align the center of each layer.

In the above-explained manufacturing method, it is preferable that the cavity in the first mold extend along three great circles intersecting each other at right angles on the base.

It is also preferable that the grooves of the cavity of the first mold have at least one shallower portion so that the shallower portion can form notches. This allows material for the interlayer to spread throughout the depressions in the interlayer molding step.

In the first mold, when the depth of the grooves of the cavity as measured from the base is set within the range of from 4.6 to 11.2 mm, the height of the ribs is sufficiently high. This makes it possible to manufacture a golf ball having a good balance of soft feeling and high bounce resilience. When the core comprises a rubber composition, it is possible to satisfactorily vulcanize the core, including around the center thereof, and to mold a core with little variation in hardness without decreasing its hardness near the center, obtaining a core having uniform hardness as a whole.

BEST MODE FOR CARRYING OUT THE INVENTION

Figure 1:
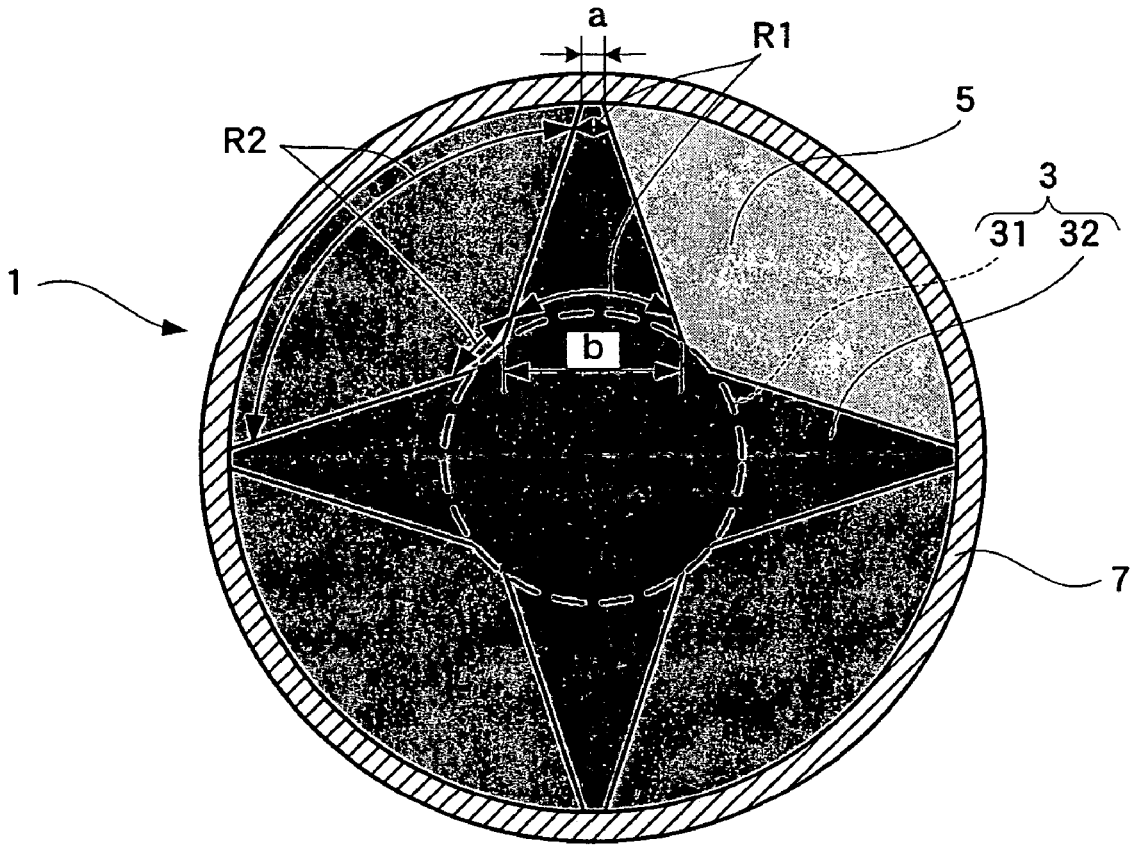
FIG. 1 is a cross-sectional view showing a golf ball of a first embodiment of the present invention.

Hereunder, a multi-piece golf ball of a first embodiment of the present invention is explained with reference to drawings. FIG. 1 is a cross-sectional view of a golf ball of the present embodiment.

As shown in FIG. 1, the golf ball 1 of the present embodiment is a so-called three-piece golf ball wherein a core 3 is covered with an interlayer 5 and a cover 7. According to the rules (see R&A and USGA), the diameter of a golf ball must be no smaller than 42.67 mm. However, taking aerodynamic characteristics and the like into consideration, it is preferable that the diameter of the ball be as small as possible. Therefore, it can be, for example, 42.7 to 43.7 mm.

Figure 2:
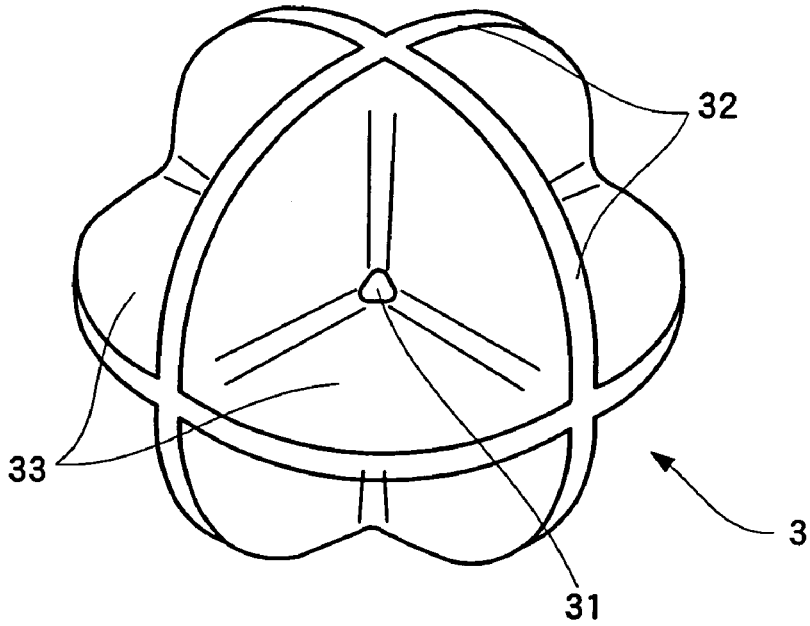
FIG. 2A is a perspective view showing the core of the golf ball of FIG. 1.
FIG. 2B is a perspective view showing a semifinished product comprising the core and an interlayer.
Figure 2:
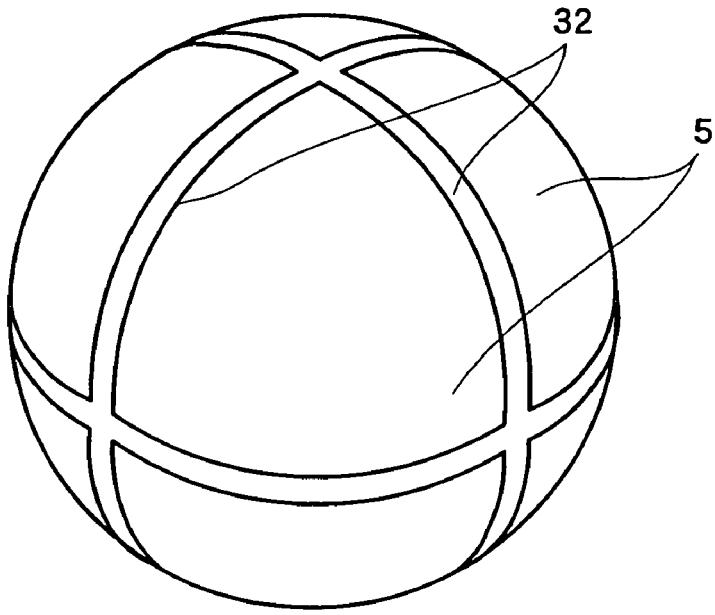

FIG. 2A is a perspective view showing the core of the golf ball of FIG. 1, and FIG. 2B is a perspective view showing a semifinished product having the core and an interlayer. As shown in FIG. 2A, the core 3 is composed of a rubber composition, and comprises a spherical main part 31 and three ribs 32 formed on the surface of the main part 31. It is preferable that the diameter of the main part 31 be 15.0 to 32.0 mm, and more preferably 17.8 to 29.6 mm.

Each of the ribs 32 extends along each of great circles drawn on the surface of the main part 31 so that they intersect each other at right angles. Eight depressions 33 are formed over the surface of the main part 31 by these ribs 32. The height of the ribs 32 is preferably within the range of from 4.6 to 11.2 mm, more preferably 5.4 to 10.2 mm, and further more preferably 7.2 to 8.8 mm. This arrangement allows an adequate length in the radial direction of the below-described graded functional region. In other words, the height of the ribs 32 may be set outside of this range, but, for example, when the ribs are lower than 4.6 mm, satisfactorily functionally graded properties cannot be obtained, making it difficult to achieve soft feeling. In contrast, when the ribs 32 are higher than 11.2 mm, the bounce resilience is decreased since the soft region is unduly large as described later, and the ribs 32 may collapse during the manufacturing process.

As shown in FIG. 1, each rib 32 is structured so as to have a trapezoidal profile in its sideways cross-section in such a manner that its width increases as it approaches the main part 31. It is preferable that the width of the top portion a of each rib in the outward radial direction be 1.5 to 3.0 mm and that the width of the bottom portion b in the inward radial direction be 5.0 to 12.0 mm. By setting a lower limit for the width of each end portion of the ribs 32, it is possible to prevent the ribs 32 from being deformed by the pressure of filling the interlayer that results from tightly closing the mold when filling the material for the interlayer during the manufacturing process. As a result, the main part 31 can be accurately held in the center of the mold. Furthermore, by setting an upper limit for the width of each end portion of the ribs 32 as described above, it is possible to prevent the area where the low-hardness ribs 32 are attached to the inner surface of the cover 7 from becoming unduly large, and this achieves an adequately soft feel when hitting the ball.

Such a shape for the ribs 32 allows the depressions 33 to form a trigonal pyramid-like shape surrounded by the three ribs 32 with the surface of the main part 31 being slightly exposed.

The core 3 having the above-described structure can be manufactured using a known rubber composition comprising a base rubber, a cross-linking agent, an unsaturated carboxylic acid metal salt, a filler, etc. Specific examples of base rubber include natural rubber, polyisobutylene rubber, styrenebutadiene rubber, EPDM, etc. Among these, it is preferable to use a high-cis polybutadiene that contains 40% or more, and preferably 80% or more cis-1,4-bonds.

Specific examples of cross-linking agents include dicumyl peroxide, t-butylperoxide, and like organic peroxides; and dicumyl peroxide is particularly preferable. The amount of cross-linking agent is generally 0.3 to 5 parts by weight, and preferably 0.5 to 2 parts by weight per 100 parts by weight of base rubber.

It is preferable to use monovalent or bivalent metal salts of acrylic acid, methacrylic acid, and like $C_3$ to $C_8$ unsaturated carboxylic acids as metal salts of unsaturated carboxylic acids. Among these, the use of zinc acrylate can improve the ball bounce resilience and is particularly preferable. The amount of unsaturated carboxylic acid metal salt is preferably 10 to 40 parts by weight per 100 parts by weight of base rubber. Examples of filler include those generally added to cores. Specific examples thereof include zinc oxide, barium sulfate, calcium carbonate, etc. The preferable amount of filler is 2 to 50 parts by weight per 100 parts by weight of base rubber. If necessary, it is also possible to add one or more antioxidants, peptizers, and the like. In addition to the above-mentioned rubber compositions, known elastomers can be used as materials for the core 3. The Shore D hardness of the core composed of the above-mentioned materials is preferably 48 to 58.

As shown in FIG. 1, the interlayer 5 has a thickness that is almost the same as the height of the ribs 32 and is inserted into the eight depressions 33 surrounded by the ribs 32, with its outline forming a substantially spherical shape. Here, the interlayer 5 is formed into a trigonal pyramid-like shape by being accommodated in each of the depressions 33. As shown in FIG. 2B, the top portions of the ribs 32 are exposed through the interlayer 5. The hardness of the interlayer 5 is set to be less than that of the core 3. For example, it is preferable that the interlayer 5 have a Shore D hardness of 35 to 50. The difference between the hardness (Shore D hardness) of the interlayer 5 and the core 3 is preferably 2 to 10, and more preferably 4 to 8.

The interlayer 5 may be composed of a rubber composition or elastomer having similar constituent components as that used for the core 3. However, when a rubber composition is used, it is preferable that the amounts of unsaturated carboxylic acids and organic peroxides be decreased to make the interlayer softer than the core 3.

When the interlayer 5 is composed of an elastomer, it is possible to use, for example, a styrene/butadiene/styrene block copolymer (SBS), a styrene/isoprene/styrene block copolymer (SIS), a styrene/ethylene/butylene/styrene block copolymer (SEBS), a styrene/ethylene/propylene/styrene block copolymer (SEPS), or like styrene-based thermoplastic elastomer; an olefin-based thermoplastic elastomer having polyethylene or polypropylene as a hard segment and butadiene rubber or ethylene/propylene rubber as a soft segment; a vinyl chloride-based plastic elastomer having crystallized poly(vinyl chloride) as a hard segment and amorphous poly(vinyl chloride) or an acrylonitrile butadiene rubber as a soft segment; a urethane-based plastic elastomer having polyurethane as a hard segment and a polyether or polyester as a soft segment; a polyester-based plastic elastomer having a polyester as a hard segment and a polyether or polyester as a soft segment; an amide-based plastic elastomer having a polyamide as a hard segment and a polyether or polyester as a soft segment; an ionomer resin, etc.

As shown in FIG. 1, the cover 7 covers the top portions of the ribs 32 and the interlayer 5, with predetermined dimples (not shown) being formed in the outer surface of the cover 7. The thickness of the cover 7 is preferably 0.8 to 2.6 mm, and more preferably 1.2 to 2.2 mm. The thickness of the cover 7 may be set outside this range; however, if the thickness of the cover 7 is less than 0.8 mm, the durability of the cover decreases remarkably and molding becomes difficult. On the other hand, if it exceeds 2.6 mm, the impact feel becomes too hard. It is preferable that its Shore D hardness be 52 to 68. The cover 7 may be composed of a known elastomer, and such an elestomer can be one of those used for the interlayer 5. Note that the thickness of the cover 7 is defined as the distance from an arbitrary point on the outermost part in the radial direction where no dimple is formed to a point that comes into contact with the interlayer measured along the normal line.

A golf ball 1 having such a structure comprises three ribs 32 on the surface of the core 3, and the interlayer 5 is accommodated in the eight concave portions 33 surrounded by the ribs 32. Therefore, in the region between the main part 31 and the cover 7, the area occupied by the ribs 32 on a spherical surface concentric to the main part 31 increases from the cover 7 to the main part 31. In other words, as shown in FIG. 1, in the vicinity of the cover 7, the proportion R2 of the interlayer 5 is large compared to the proportion R1 of the ribs 32. In contrast, the proportion R1 of the ribs 32 becomes larger in the vicinity of the main part 31. In the multi-piece golf ball of the present embodiment, because the hardness of the rib 32 is greater than that of the interlayer 5, the ball is overall softer in the vicinity of the cover 7, strongly reflecting the property of the interlayer 5, and gradually becomes harder toward the main part 31, strongly reflecting the property of the ribs 32. Because the hardness of the interlayer 5 is low in the vicinity of the cover 9, soft feel can be obtained in the initial stage of impact, while the hardness increases as impact progresses, obtaining high ball bounce resilience. Because the golf ball 1 of the present embodiment has functionally graded properties in which the hardness thereof smoothly changes in the region between the cover 7 and the main part 31, it achieves a good balance between soft feel and high ball bounce resilience.

In this structure, because the softer interlayer 5 is accomodated in the concave portions 33 surrounded by the harder ribs 32, deformation of the interlayer 5 in the spherical surface direction is limited by the ribs 32. This prevents the striking force from being dispersed in directions along the spherical surface, and efficiently transfers the striking force to the center of the ball. As a result, in spite of the soft feel, a long carry distance can be attained.

When the striking force is mainly directed to the center of the ball, in particular when a driver is used, because the proportion of the interlayer decreases towards the center of the core 3 (i.e., in the direction in which striking force is transferred), a long carry distance can be achieved in spite of the soft feeling. In contrast, when an iron is used, the striking force is greatly directed in a direction tangential to the ball. Here, the proportion of the area of the soft interlayer 5 is large in the vicinity of the cover. As a result, when an iron is used, a soft feeling can be obtained.

One embodiment of the present invention is described above, but the present invention is not limited to this embodiment and various modifications may be added as long as they do not depart from the sprit of the invention. For example, in the above embodiment, the ribs 32 are so formed as to extend along great circles, but this is not necessary as long as a plurality of depressions 33 in which the interlayer 5 can be accommodated are formed. However, when the ribs are formed along great circles, the area of the ribs on the surface of the core is relatively small, and that of the interlayer is great. In this structure, the club can easily give an impact on the interlayer, obtaining soft feeling.

Figure 3:
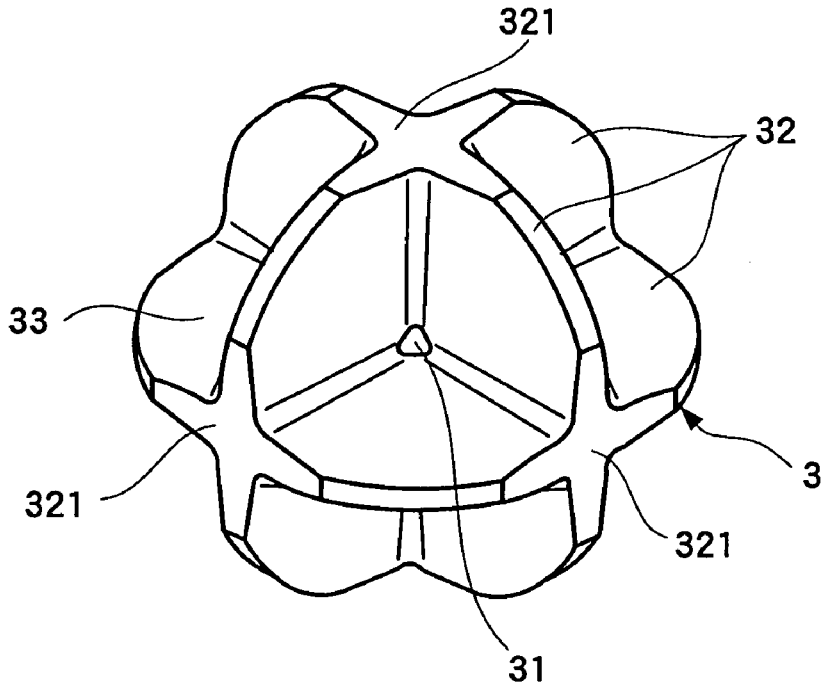
FIG. 3 is a perspective view showing another example of the core of the golf ball of FIG. 1.
Figure 4:
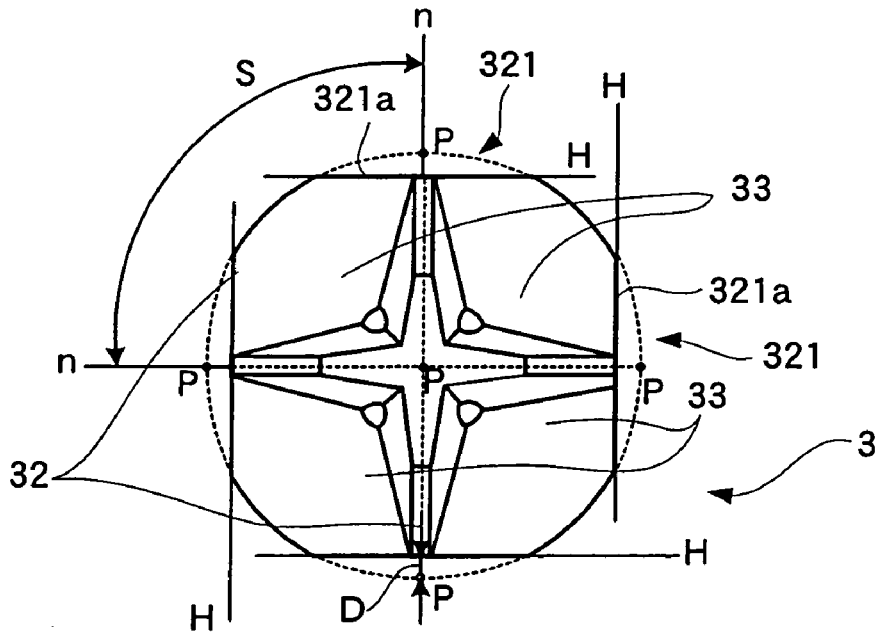
FIG. 4 is a cross-sectional view showing the core of FIG. 3.

As shown in FIG. 3, notches may be formed in portions of the ribs 32. In this example, each rib 32 has a notch 321 in the vicinity of an intersection of the great circles. To be more specific, as shown in FIG. 4, the notch 321 is structured so as to have a bottom surface 321*a* extending along a plane H perpendicular to a normal line n of the main part 31 that passes through an intersection P of the great circles. In other words, the notch 321 is formed by excising the rib 32 at the plane H. Note that it is preferable that the depth D of the notch 321, i.e., the distance from the top portion of a virtual rib 32 without a notch 321 to the innermost portion of the notch 321, be within the range of from 1.2 to 2.4 mm.

Figure 5:
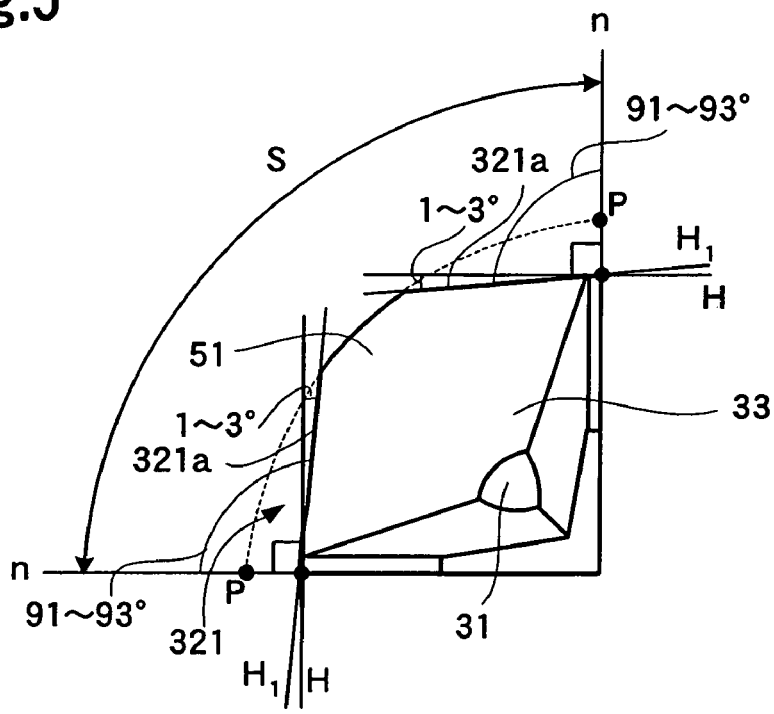
FIG. 5 is a partial cross-sectional view showing another example of the core of FIG. 3.

By forming notches 321 in this manner, four depressions 33 that are arranged so as to have a common meeting point at an intersection P of the great circles are made to communicate with each other, and material for the interlayer can readily spread between the depressions 33 via the notches 321. In this case, as shown in FIG. 5, it is also possible to form the bottom surface 321*a* of the notch 321 along a plane $H_1$ that extends away from the plane H by being slanted toward the center of the rib 11 by 1 to 3°, i.e., a plane having an angle made between the normal line n of the main part 31 passing through the intersection P is 91 to 93° as viewed from the front. This arrangement enables the angle to serve as a draft, and, for example, when a core is molded using two molds, such as an upper mold and a lower mold, the core 3 can be easily removed from the mold.

Figure 6:
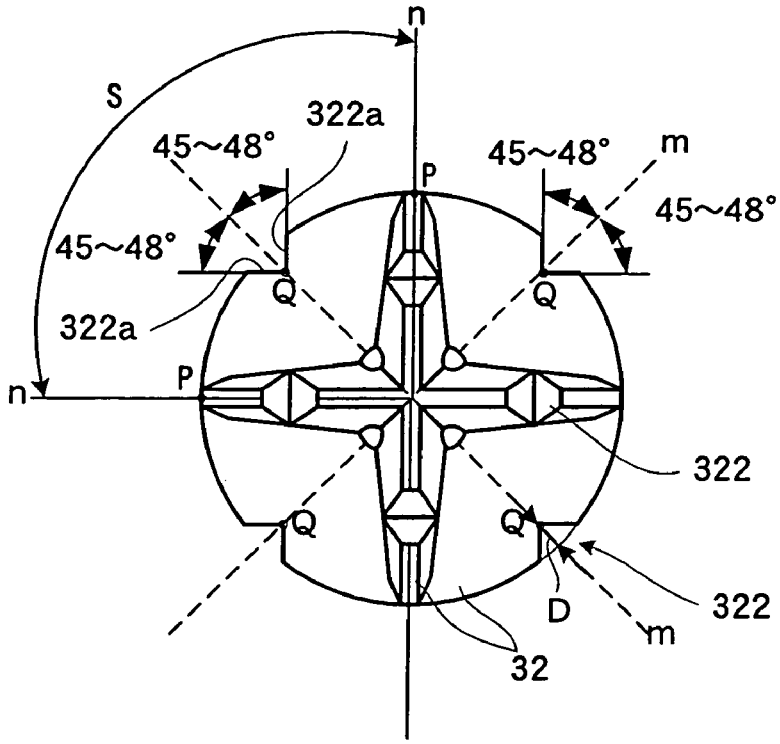
FIG. 6 is a cross-sectional view showing another example of the core of FIG. 3.

It is also possible to form a notch in the middle of the arc section S formed between each intersection P of each rib 32. In other words, as shown in FIG. 6, a notch 322 may be formed so as to have two bottom surfaces 322*a* each extending toward the intersections P from a point on a normal line m of the main part 31 that passes through the mid point Q of each arc section in the arc direction. In this case, it is preferable that the angle between the bottom surface 322*a* and the normal line m be 45 to 48° as viewed from the front. This arrangement makes it possible to easily remove the core 3 from the mold.

Figure 7:
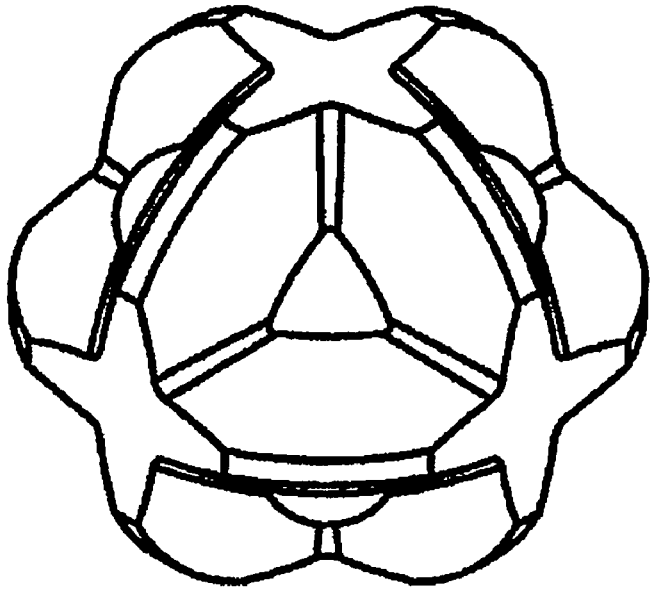
FIG. 7A is a perspective view and FIG. 7B is a front view showing another example of the core of the golf ball of FIG. 2.
Figure 7:
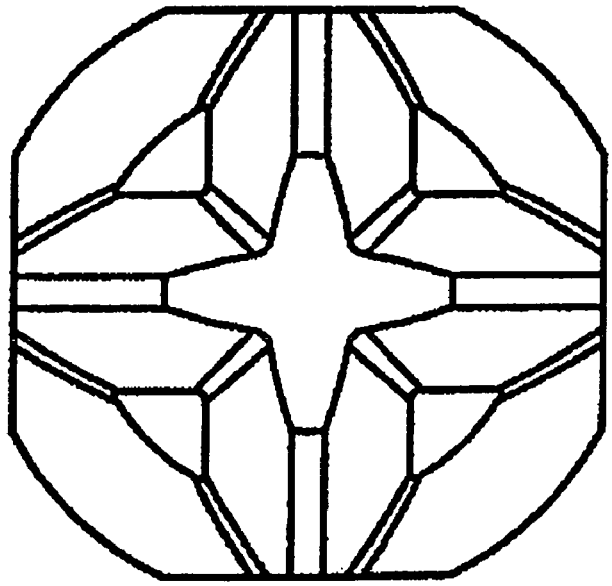

In some embodiments, the depression is formed into a cone-like shape by being surrounded only by ribs, while in other embodiments, the main part is exposed at the bottom of the depression, and side faces of the ribs and the main part together define the cone-like shape. When the ribs are short, the area of the exposed portions of the main part is large, and therefore, as shown in FIG. 7, the depressions are sometimes formed into a truncated tetrahedron-like shape. Therefore, the shape of the depression of the present invention include such a truncated tetrahedron-like shape.

Figure 8:
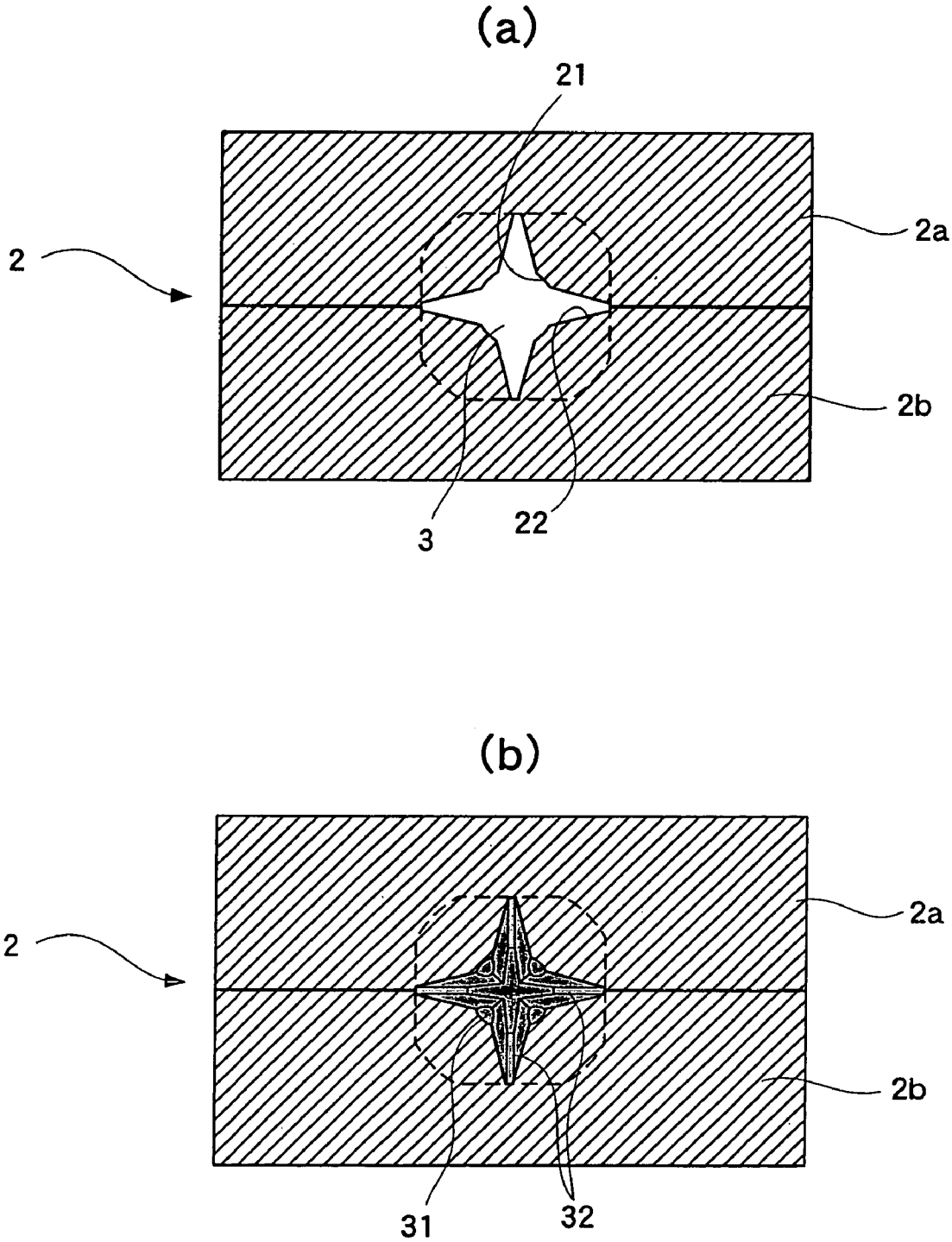
FIGS. 8A and 8B show the steps of manufacturing a golf ball having the core of FIG. 3.
Figure 9:
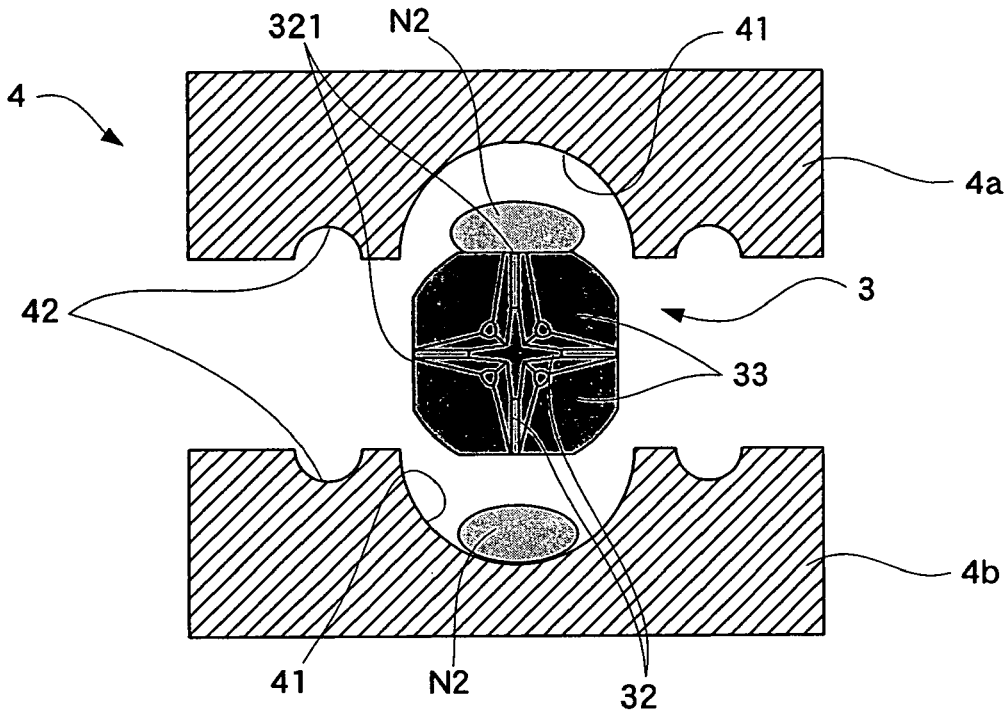
FIGS. 9A and 9B show the steps of manufacturing a golf ball having the core of FIG. 3.
Figure 9:
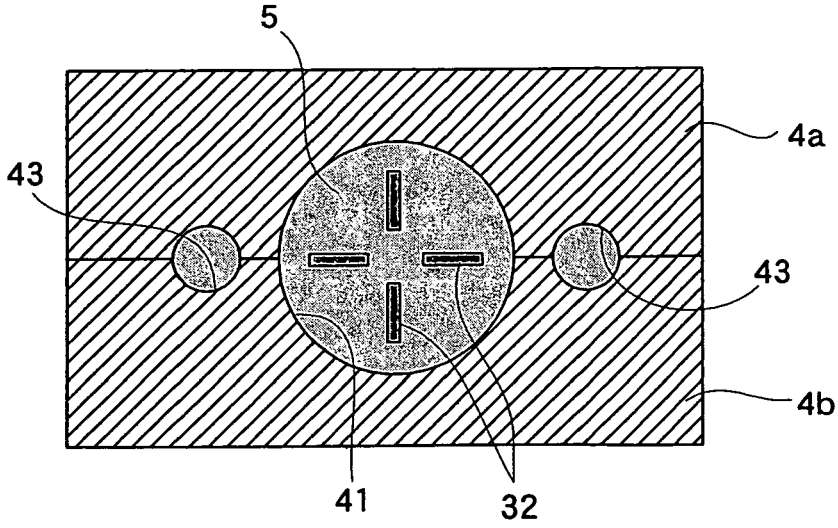

Hereunder, one example of a manufacturing method of a golf ball having an above structure is explained with reference to drawings. A method wherein the interlayer is composed of a rubber composition is explained below. FIGS. 8 and 9 show the method for manufacturing a three-piece golf ball having a core as shown in FIG. 3.

First, the core is formed using a first mold as shown in FIG. 8A. The first mold 2 comprises an upper mold 2*a* and a lower mold 2*b*. Each of the upper mold 2*a* and the lower mold 2*b* comprises a cavity provided with a base 21 having a hemispherical surface and grooves 22 formed in the surface of the base 21. The base 21 corresponds to the main part 31, and the inside diameter of the hemispherical surface is 15.0 to 32.0 mm. The grooves 22 are portions for forming the ribs 32 and are formed along great circles on the surface of the base 21. The grooves at the intersections of the three great circles are shallower than elsewhere. This forms the above-described notches 321. The protrusions surrounded by the grooves 22 are so formed as to be wider approaching the depth ends of the grooves, i.e., a trigonal pyramid widening toward the end. These protrusions are provided for forming the above-described depressions. The surface of the cavity is roughly finished by rough grinding. By roughly finishing, fine irregularities can be made in the surface of the obtained ribs 32, thus increasing the contact with the interlayer 5.

Second, as shown in FIG. 8B, unvulcanized rubber composition N1 is placed in the cavity and fully vulcanized by conducting press molding, for example, at 140 to 165° C. for 6 to 25 minutes, forming core 3. The core 3 may be formed of an elastomer as described above, and, in this case, the core can be formed by press molding or injection molding.

Subsequently, the core 3 is removed from the first mold 2 and placed in a second mold 4. As shown in FIG. 9A, the second mold 4 comprises an upper mold 4*a* and a lower mold 4*b*, the upper mold 4*a* and the lower mold 4*b* each has a hemispherical cavity 41 corresponding to the outermost diameter of the ribs 31. In other words, the top portions of the ribs 32 are designed to contact the surface of the cavities 41. The cavities 41 of the upper mold 4*a* and lower mold 4*b* have the same kind of roughly finished surfaces as those of the first mold 2. A plurality of depressions 42 for holding excess flow are formed around each cavity 41.

As shown in FIG. 9A, an unvulcanized rubber composition N2 is placed in the cavity 41 in the lower mold 4*b*, a rubber composition N2 is placed on the core that was formed as described above, and the core is placed between the upper mold 4*a* and the lower mold 4*b*. Then, as shown in FIG. 9B, the upper mold 4*a* and the lower mold 4*b* are brought into contact, and the rubber composition N2 is fully vulcanized at 140 to 165° C. for 6 to 25 minutes and subjected to press molding, thus obtaining an interlayer 5.

Figure 10:
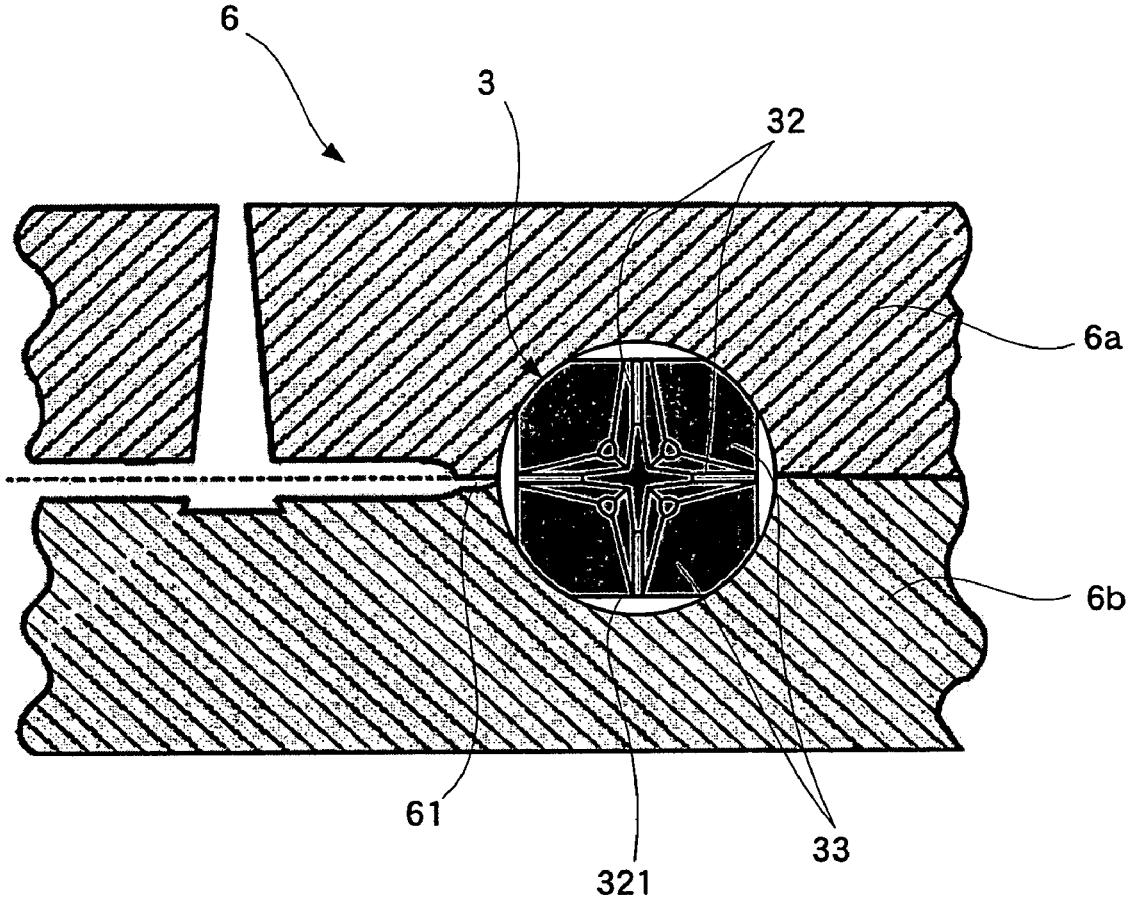
FIG. 10 shows another example of the steps of manufacturing the golf ball of FIG. 7.

Here, the rubber composition N2 placed on the core 3 and in the cavity 41 of the lower mold 4*a* fill the depressions 33 while being pressed against the surface of the core 3. As described above, the adjacent depressions 33 communicate with each other through notches 321, and therefore the rubber composition N2 spreads throughout the depressions 33 and uniformly fills the space therein. The second interlayer 5 may be formed by injection molding using a mold 6 as shown in FIG. 10. In this case, if no notches 321 are provided, it is impossible to uniformly place the rubber composition N2 in each depression 33 without providing a gate for each depression 33. However, by providing notches 321 in the ribs 32, it is possible to uniformly place the rubber composition in the depressions 33 by inserting the rubber composition from a single gate 61 after placing a semifinished product in the molds 6*a* and 6*b*.

As described above, notches 321 are provided in the ribs 32 and the adjacent depressions 33 communicate with each other through a notch 321, and therefore the rubber composition N2 spreads throughout the depressions 33 and uniformly fills the space therein when pressed from any position on the surface of the semifinished product. Therefore, it is possible to cover the surface of the semifinished product with the interlayer 5 by a single step of press molding, significantly reducing the manufacturing time. Here, the interlayer 5 is composed of a rubber composition, but it is also possible to form the interlayer 5 with an elastomer. When an elastomer is used, the interlayer 5 may be formed by injection molding.

When the molding of the interlayer 5 is completed, a semifinished product comprising a core 3 and an interlayer 5 is removed from the second mold 4. Subsequently, by covering the semifinished product with a cover 7 by press molding or injection molding in such a manner that the cover 7 has predetermined dimples thereon, a golf ball of the present embodiment is obtained.

Note that a golf ball comprising an interlayer with notches is explained above; however, it is also possible to form a golf ball comprising an interlayer 5 without notches in almost the same manner. When notches are not provided, it is necessary to conduct press molding by positioning the interlayer material so that the material can be inserted into each of the depressions, or, when injection molding is conducted, a plurality of gates corresponding to each depression must be provided.

By employing the manufacturing method as described above, because the inside diameter of the base 21 of the first mold 2 is relatively small, it is possible to satisfactorily vulcanize the center of the core 3. This achieves the following effects. If the diameter of the core is large, it is difficult to satisfactorily vulcanize the center thereof, and this varies the hardness around the center. In contrast, if the diameter of the main part is relatively small by using the first mold as described above, it is possible to form the core 3 having a uniform hardness.

In the second mold 4, because the cavities 41 correspond to the outermost diameter of the rib 32, it is possible to insert an interlayer material with the ribs 32 in contact with the surface of a cavity 41. Therefore, the core 3 can be easily centered, and this makes it possible to accurately align the center of each layer.

EXAMPLES

Examples of the present invention and Comparative Examples will be explained below. First, 8 types of golf balls according to the present invention are compared with 2 types of golf balls according to Comparative Examples. The golf balls in each Example comprise the core of FIG. 5. Materials for the golf balls of Examples and Comparative Examples are shown in Table 1.

TABLE 1

| | | Ex. 1 | Ex. 2 | Ex. 3 | Ex. 4 | Ex. 5 | Ex. 6 | Ex. 7 | Ex. 8 | Comp. Ex.1 | Comp. Ex. 2 |
|---|---|---|---|---|---|---|---|---|---|---|---|
| Core | BR | 100 | 100 | 100 | 100 | 100 | 100 | 100 | 100 | 100 | 100 |
| | Zinc oxide | 5 | 5 | 5 | 5 | 5 | 5 | 5 | 5 | 5 | 5 |
| | Barium sulfate | 16 | 16 | 16 | 15 | 17 | 15 | 13 | 19 | 17 | 16 |
| | Crosslinking initiator | 2 | 2 | 2 | 2 | 2 | 2 | 2 | 2 | 2 | 2 |
| | Zinc acrylate | 24 | 24 | 24 | 26 | 23 | 26 | 30 | 17 | 21 | 24 |
| | Magnesium carbonate | 2 | 2 | 2 | 2 | 1 | 2 | 2 | 2 | 2 | 2 |
| | Antioxidant | 0.1 | 0.1 | 0.1 | 0.1 | 0.1 | 0.1 | 0.1 | 0.1 | 0.1 | 0.1 |
| Interlayer | BR | 100 | 100 | 100 | 100 | 100 | 100 | 100 | 100 | 100 | 100 |
| | Zinc oxide | 5 | 5 | 5 | 5 | 5 | 5 | 5 | 5 | 5 | 5 |
| | Barium sulfate | 18 | 18 | 18 | 19 | 18 | 19 | 17 | 20 | 17 | 18 |
| | Crosslinking initiator | 2 | 2 | 2 | 2 | 2 | 2 | 2 | 2 | 2 | 2 |
| | Zinc acrylate | 19 | 19 | 19 | 17 | 19 | 16 | 21 | 14 | 21 | 19 |
| | Magnesium carbonate | 2 | 2 | 2 | 2 | 2 | 2 | 2 | 2 | 2 | 2 |
| | Antioxidant | 0.1 | 0.1 | 0.1 | 0.1 | 0.1 | 0.1 | 0.1 | 0.1 | 0.1 | 0.1 |
| Cover | HIMILAN 1706 | 50 | 50 | 50 | 50 | 50 | 50 | 50 | 50 | 50 | 50 |
| | HIMILAN 1605 | 50 | 50 | 50 | 50 | 50 | 50 | 50 | 50 | 50 | 50 |

Table 2 shows the thickness of the interlayer (when ribs are provided, substantially the same as the height of the ribs), whether ribs are provided or not, and the hardness of each component of the golf balls. The hardness of each component of the golf balls is shown as Shore D hardness.

TABLE 2

| | Diameter of core (main part) (mm) | Thickness of interlayer (mm) | Ribs | Hardness of core | Hardness of interlayer | Hardness of cover |
|---|---|---|---|---|---|---|
| Example 1 | 23.3 | 8 | Provided | 54 | 48 | 62 |
| Example 2 | 19.3 | 11 | Provided | 54 | 48 | 62 |
| Example 3 | 27.3 | 5 | Provided | 54 | 48 | 62 |
| Example 4 | 19.3 | 10 | Provided | 56 | 46 | 62 |
| Example 5 | 27.3 | 6 | Provided | 52 | 48 | 62 |
| Example 6 | 23.3 | 8 | Provided | 56 | 44 | 62 |
| Example 7 | 19.3 | 10 | Provided | 60 | 50 | 62 |
| Example 8 | 27.3 | 6 | Provided | 46 | 42 | 62 |
| Comp. Ex. 1 | 23.3 | 8 | Provided | 50 | 50 | 62 |
| Comp. Ex. 2 | 23.3 | 8 | Not provided | 54 | 48 | 62 |

Using the golf balls obtained in the Examples and Comparative Examples, hitting tests were conducted using a hitting robot (manufactured by Miyamae Co., Ltd.: product name "SHOT ROBO V") with a number one wood (1W: Mizuno Corporation; Mizuno MP-001, loft angle: 9.5°, shaft length: 45 inches (114.3 cm), shaft flex: S, with a Tour Spirit MP Carbon Shaft) and a number five middle iron (5I: manufactured by Mizuno Corporation;

T-ZOID·MX-15, loft angle: 27°, length: 37.5 inches (95.25 cm), shaft flex: S), and the carry distances were measured. The head speed of the 1W was set at 45 m/s and that of the 5I was set at 35 m/s. Tests of the feeling when the balls were hit (impact feeling) were conducted by ten amateurs using a 1W. The ten amateurs were asked to select either 1: soft, 2: slightly soft, 3: fair, 4: slightly hard, or 5: hard to evaluate the feeling when the balls were hit and the average value of all values selected was defined as the feeling value for each Example and Comparative Example. Table 3 shows the results.

TABLE 3

| | 1W | | 5I | |
|---|---|---|---|---|
| | Carry (m) | Feeling | Carry (m) | Feeling |
| Example 1 | 200.2 | 3.0 | 150.4 | 2.9 |
| Example 2 | 197.9 | 2.7 | 146.3 | 2.7 |
| Example 3 | 201.3 | 3.2 | 142.2 | 3.0 |
| Example 4 | 200.9 | 3.2 | 150.0 | 2.6 |
| Example 5 | 197.4 | 2.6 | 146.9 | 2.7 |
| Example 6 | 197.1 | 3.5 | 142.2 | 2.3 |
| Example 7 | 202.0 | 4.2 | 151.7 | 4.0 |
| Example 8 | 195.4 | 2.1 | 141.8 | 1.9 |
| Comp. Ex 1 | 195.8 | 3.0 | 150.7 | 3.6 |
| Comp. Ex. 2 | 196.3 | 2.8 | 142.1 | 2.2 |

As is clear from Table 3, the golf balls of Examples 1 to 5 attained satisfactory carry distances and impact feeling. The golf ball of Example 6 is slightly lacking balance in hardness because of a great variance between the hardness of the core and that of the interlayer, and therefore its carry distance was reduced compared to the golf ball of Example 1 having a similar structure, and the impact feeling, in particular when a driver was used, felt hard. Because the golf ball of Example 7 has a hard core, the carry distance was satisfactory but the impact felt harder than Examples 1 to 5. Because a soft core was used in Example 8, impact feel was excellent but the carry distance was shorter than Examples 1 to 5.

In contrast, there is no variance in hardness between the core and the interlayer in the golf ball of Comparative Example 1, and it can be assumed that the ribs do not effectively receive the deformation of the interlayer. As a result, compared to the golf ball of Example 1, the carry distance was reduced when a driver was used, regardless of the fact that the impact feeling was almost the same, and the impact felt hard when an iron was used, regardless of the fact that the carry distance was almost the same.

Because no ribs were provided in the golf ball of Comparative Example 2, it can be assumed that the striking force is dispersed in the circumferential direction due to the deformation of the interlayer, causing a loss in the striking force. As a result, the carry distance was reduced compared to the golf ball of Example 1 having the same structure other than the presence or absence of the ribs.

INDUSTRIAL APPLICABILITY

The present invention provides a multi-piece golf ball that can attain both satisfactorily soft feeling and high bounce resilience, and a method for manufacturing such a golf ball.

The invention claimed is:

1. A multi-piece golf ball comprising:

a core;

an interlayer; and a cover;

wherein the core comprises a spherical main part and three ribs provided on the main part, each of the three ribs extends along one of three great circles intersecting each other at right angles on the surface of the main part to form eight depressions surrounded by ribs, the interlayer is accommodated in the eight depressions surrounded by the ribs, and has a thickness substantially the same as the height of the ribs, each of the ribs extends in such a manner that the width thereof becomes greater from the cover towards the core, each of the depressions is formed into a cone-like shape by side faces of the ribs, and the hardness of the interlayer is less than that of the core.

2. A multi-piece golf ball, comprising:
a core;
an interlayer; and
a cover;
wherein the core comprises a spherical main part and a plurality of ribs provided on the main part,
the interlayer is accommodated in depressions surrounded by the ribs, and has a thickness substantially the same as the height of the ribs,
each of the ribs extends in such a manner that the width thereof becomes greater from the cover towards the core,
each of the depressions is formed into a cone-like shape by side faces of the ribs, and
the hardness of the interlayer is less than that of the core; and
wherein the height of the ribs as measured from the main part is within the range of from 4.6 to 11.2 mm.

3. A multi-piece golf ball according, comprising
a core;
an interlayer; and
a cover;
wherein the core comprises a spherical main part and a plurality of ribs provided on the main part,
the interlayer is accommodated in depressions surrounded by the ribs, and has a thickness substantially the same as the height of the ribs,
each of the ribs extends in such a manner that the width thereof becomes greater from the cover towards the core,
each of the depressions is formed into a cone-like shape by side faces of the ribs, and
the hardness of the interlayer is less than that of the core; and
wherein each of the ribs comprises at least one notch so as to form a passageway between adjacent depressions.

4. A multi-piece golf ball comprising
a core;
an interlayer; and
a cover;
wherein the core comprises a spherical main part and a plurality of ribs provided on the main part,
the interlayer is accommodated in depressions surrounded by the ribs, and has a thickness substantially the same as the height of the ribs,
each of the ribs extends in such a manner that the width thereof becomes greater from the cover towards the core,
each of the depressions is formed into a cone-like shape by side faces of the ribs, and
the hardness of the interlayer is less than that of the core; and
wherein each of the ribs extends along one of three great circles intersecting each other at right angles on the surface of the main part,
a notch, by which four concave portions that are arranged so as to have a common meeting point at an intersection of the great circles are made to communicate with each other, is formed by excising ribs at a plane that is perpendicular to a normal line of the core passing through an intersection of the great circles.

5. A multi-piece golf ball comprising
a core;
an interlayer; and
a cover;
wherein the core comprises a spherical main part and a plurality of ribs provided on the main part,
the interlayer is accommodated in depressions surrounded by the ribs, and has a thickness substantially the same as the height of the ribs,
each of the ribs extends in such a manner that the width thereof becomes greater from the cover towards the core,
each of the depressions is formed into a cone-like shape by side faces of the ribs, and
the hardness of the interlayer is less than that of the core; and
wherein each of the ribs extends along one of three great circles intersecting each other at right angles on the surface of the main part,
an arc section on each of the ribs partitioned by intersections of the great circles is provided with a notch,
each notch has a plane extending along the arc section from one point on a normal line of the core that passes through one of the intersections of the great circles, and
the plane has an angle that is not smaller than 90 degree relative to the normal line.

6. A multi-piece golf ball comprising
a core;
an interlayer; and
a cover;
wherein the core comprises a spherical main part and a plurality of ribs provided on the main part,
the interlayer is accommodated in depressions surrounded by the ribs, and has a thickness substantially the same as the height of the ribs,
each of the ribs extends in such a manner that the width thereof becomes greater from the cover towards the core,
each of the depressions is formed into a cone-like shape by side faces of the ribs, and
the hardness of the interlayer is less than that of the core; and
wherein the ribs extend along three great circles intersecting each other at right angles on the surface of the core,
an arc section on each of the ribs partitioned by the intersections of the great circles is provided with a notch,
the notch is formed in the middle of each arc section in the arc direction, and
each notch has two planes, each extending toward an intersection from one point on a normal line of the core that passes through the mid point of each arc section in the arc direction, wherein the angle made between the plane and the normal line is 45 to 48°.

7. A method for manufacturing a multi-piece golf ball comprising a core, an interlayer, and a cover, comprising:
preparing a first mold comprising a cavity provided with a base having a spherical surface and a plurality of grooves formed along the surface of the base having substantially the same depth as each other as measured from the surface and whose width narrows as they become deeper, and protrusions surrounded by the grooves formed into a cone-like shape;
molding a core having a plurality of ribs on the surface of a spherical main part by inserting a core material into the cavity of the first mold;
preparing a second mold having a spherical cavity corresponding to the outermost diameter of the core;

molding an interlayer whose hardness is less than that of the core by placing the core removed from the first mold into the cavity of the second mold, and then inserting an interlayer material into depressions surrounded by the ribs; and molding a cover over the interlayer.

8. The method for manufacturing a multi-piece golf ball according to claim 7, wherein the cavity of the first mold is structured so as to extend along three great circles intersecting each other at right angles on the base.

9. The method for manufacturing a multi-piece golf ball according to claim 7, wherein the cavity of the first mold is structured so that at least one shallower portion is formed in the grooves.

10. The method for manufacturing a multi-piece golf ball according to claim 7, wherein the depth of the grooves as measured from the base of the cavity of the first mold is within a range of from 4.6 to 11.2 mm.

* * * * *